US007848846B2

(12) United States Patent
Uema et al.

(10) Patent No.: US 7,848,846 B2
(45) Date of Patent: Dec. 7, 2010

(54) MEDICINE SUPPLY APPARATUS

(75) Inventors: Shinya Uema, Gunma (JP); Manabu Haraguchi, Gunma (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 15 days.

(21) Appl. No.: 10/745,374

(22) Filed: Dec. 22, 2003

(65) Prior Publication Data

US 2004/0134043 A1 Jul. 15, 2004

(30) Foreign Application Priority Data

Dec. 25, 2002 (JP) ..... 2002-374902

(51) Int. Cl.
*G06F 17/00* (2006.01)

(52) U.S. Cl. ..... 700/243; 700/242; 700/239; 700/232; 221/8; 221/12; 221/9; 221/83; 221/85; 221/119; 221/121

(58) Field of Classification Search ..... 221/19, 221/65, 123, 124, 258, 1–312 C, 7, 82–86, 221/12, 9, 2, 8, 119, 121; 700/231–244
See application file for complete search history.

(56) References Cited

U.S. PATENT DOCUMENTS 4,722,058 A * 1/1988 Nakayama et al. ..... 700/243
5,348,061 A * 9/1994 Riley et al. ..... 141/104
5,431,299 A * 7/1995 Brewer et al. ..... 221/2
5,709,063 A * 1/1998 Yuyama et al. ..... 53/154
5,720,154 A 2/1998 Lasher et al.
5,745,366 A * 4/1998 Higham et al. ..... 700/242
5,805,455 A 9/1998 Lipps
5,901,876 A * 5/1999 Yuyama et al. ..... 221/133
5,907,493 A 5/1999 Boyer et al.
6,073,799 A * 6/2000 Yuyama et al. ..... 221/154
6,170,699 B1 * 1/2001 Kim ..... 221/85
6,349,848 B1 * 2/2002 Uema et al. ..... 221/6

(Continued)

FOREIGN PATENT DOCUMENTS

EP 1 241 617 A2 9/2002

(Continued)

OTHER PUBLICATIONS

Korean Office Action dated May 31, 2010, issued in corresponding Korean patent Application No. 10-2003-95940.

*Primary Examiner*—Gene Crawford
*Assistant Examiner*—Michael K Collins
(74) *Attorney, Agent, or Firm*—Westerman, Hattori, Daniels & Adrian, LLP

(57) ABSTRACT

A medicine supply apparatus for filling medicines into containers has a plurality of reception compartments into which each of a plurality of medicines are to be respectively selectively fed by a user based on prescription data stored in a processor, a discharge apparatus for discharging the medicines from each of the reception compartments, and filling apparatus for filling the medicines discharged from the reception compartments into containers. An LED lamp is identifiably related to each of the plurality of reception compartments to indicate the reception compartment into which a particular medicine is to be fed based on the prescription data and a control device controls the discharge apparatus to discharge the medicine from the reception compartment and the filling apparatus.

7 Claims, 11 Drawing Sheets

U.S. PATENT DOCUMENTS

| | | | | |
|---|---|---|---|---|
| 6,581,356 | B2 * | 6/2003 | Kim | 53/154 |
| 6,644,504 | B2 * | 11/2003 | Yuyama et al. | 221/265 |
| 6,658,322 | B1 * | 12/2003 | Frederick et al. | 700/236 |
| 6,847,861 | B2 * | 1/2005 | Lunak et al. | 700/242 |
| 7,010,389 | B2 * | 3/2006 | Lunak et al. | 700/243 |
| 7,398,895 | B2 * | 7/2008 | Kim | 221/154 |
| 2003/0230590 | A1 * | 12/2003 | Gilmore | 221/2 |
| 2004/0158507 | A1 * | 8/2004 | Meek et al. | 705/28 |
| 2005/0021175 | A1 * | 1/2005 | Bain | 700/236 |
| 2006/0237002 | A1 * | 10/2006 | Bonney et al. | 128/200.23 |
| 2006/0241806 | A1 * | 10/2006 | Handfield et al. | 700/231 |

FOREIGN PATENT DOCUMENTS

| | | |
|---|---|---|
| JP | 57-5282 | 2/1982 |
| JP | 6-80103 A | 3/1994 |

* cited by examiner

FIG.13

PATIENT ID: 123456 AGE: 63 MALE
PATIENT NAME: TARO SANYO MEDICAL DEPARTMENT: UROLOGY

| | SUNDAY | | | | MONDAY | | | | TUESDAY | | | | WEDNESDAY | | | | THURSDAY | | | | FRIDAY | | | | SATURDAY | | | |
|---|---|---|---|---|---|---|---|---|---|---|---|---|---|---|---|---|---|---|---|---|---|---|---|---|---|---|---|---|
| | α | β | θ | λ | α | β | θ | λ | α | β | θ | λ | α | β | θ | λ | α | β | θ | λ | α | β | θ | λ | α | β | θ | λ |
| TABLET A | | | 1 | | | | 1 | | | | 1 | | | | 1 | | | | 1 | | | | 1 | | | | 1 | |
| TABLET B | 1 | 1 | 1 | | | | 1 | | 1 | 1 | 1 | | 1 | 1 | 1 | | | | 1 | | 1 | 1 | 1 | | 1 | 1 | 1 | |
| TABLET C | 2 | | 2 | | | | 2 | | 2 | | 2 | | 2 | | 2 | | | | 2 | | 2 | | 2 | | 2 | | 2 | |
| TABLET D | | | | | | | 1 | | | | | | | | | | | | 1 | | | | | | | | | |

(DIALYSIS DAY) (DIALYSIS DAY)

α : MORNING
β : NOON
θ : EVENING
λ : SLEEP

FIG.14

PATIENT ID: 123456 AGE 63 MALE
PATIENT NAME: TARO SANYO UROLOGY

37

| | |
|---|---|
| * TABLET A | 1 |
| TABLET B | 1 |
| TABLET C | 2 |
| TABLET D | 1 |

MEDICINE SUPPLY APPARATUS

BACKGROUND OF THE INVENTION

The present invention relates to a medicine supply apparatus for filling a given quantity of medicines specified by a prescription into a container (bag, vial, or the like) and supplying it in a hospital, a pharmacy, or the like.

In medical facilities such as hospitals, pharmacies, or the like, a medicine supply apparatus (tablet packing machine) as described in JP-Y-S57-5282 has been conventionally used to offer medicines prescribed by a doctor to a patient. In such an apparatus, the medicines (tablets, capsules, or the like) in the quantity described in a prescription (prescription data) are discharged from a discharge drum (alignment board) in a tablet case one by one, then collected by a hopper via a chute, and then packed per dose by packing paper, or filled into a vial.

On the other hand, the medicine supply apparatus is provided with a feeder called a UTC for those medicines that are not prepared very often or that are packed in addition to medicines from a tablet case. The feeder does not discharge medicines from a tablet case and can receive medicines that are voluntarily introduced thereinto. The feeder is provided with a plurality of reception compartments into which medicines can be voluntarily fed by a user, and is configured such that the respective reception compartments are rotatable by the use of a belt.

Then, based on the foregoing prescription data, a reception compartment containing medicines to be packed is moved by the belt to a position where a shutter is located, then the shutter is opened so that the medicines in the subject reception compartment are discharged into the foregoing hopper. However, there has been a drawback that, upon feeding medicines into a reception compartment, it is difficult for a user to grasp which of the reception compartments the medicines should be thrown into. There has also been a problem that if the medicines are put into wrong reception compartments, the medicines are resultantly packed according to a wrong prescription.

SUMMARY OF THE INVENTION

The present invention has been made for solving the foregoing conventional technical problems, and has an object, in a medicine supply apparatus for filling medicines into containers using a plurality of reception compartments into which medicines can be voluntarily fed, to improve usability of the apparatus and prevent supply of wrong medicines.

A medicine supply apparatus of the present invention comprises a plurality of reception compartments into which medicines can be respectively put arbitrarily, discharge means for discharging the medicines in the reception compartments, respectively, and filling means for filling the medicines discharged from the reception compartments into containers such as bags or vials, and further comprises guide means for identifiably showing the plurality of reception compartments, respectively, and control means for controlling the discharge means, the guide means, and the filling means, wherein the control means, based on given prescription data, controls the discharge means to discharge the medicine from the reception compartment, or controls the guide means to show the reception compartment into which the medicine should be put. Therefore, a user can easily and securely put the medicine into the reception compartment that should receive the medicine. Thereby, it becomes possible to improve the usability and securely prevent occurrence of wrong preparation of the medicines.

Further, a medicine supply apparatus of the present invention is configured that, in the foregoing invention, the guide means switchingly shows the reception compartment into which the medicine should be put, depending on a kind of medicine. Therefore, the operability becomes highly excellent even when feeding a plurality of kinds of medicines into different reception compartments in a mixed manner.

Moreover, a medicine supply apparatus of the present invention is configured that, in each of the foregoing inventions, the guide means comprises display means provided correspondingly to the plurality of reception compartments, and shows the reception compartment into which the medicine should be put, by lighting the display means. Therefore, the user can definitely discriminate the reception compartment to be fed with the medicine from the others. Thereby, it becomes possible to further improve the usability and reliability.

BRIEF DESCRIPTION OF THE DRAWINGS

FIG. 13 is a diagram showing one example of prescription data; and

FIG. 14 is a diagram showing a display state of a control panel of the medicine supply apparatus of FIG. 1.

DETAILED DESCRIPTION OF THE PREFERRED EMBODIMENT

Figure 1:
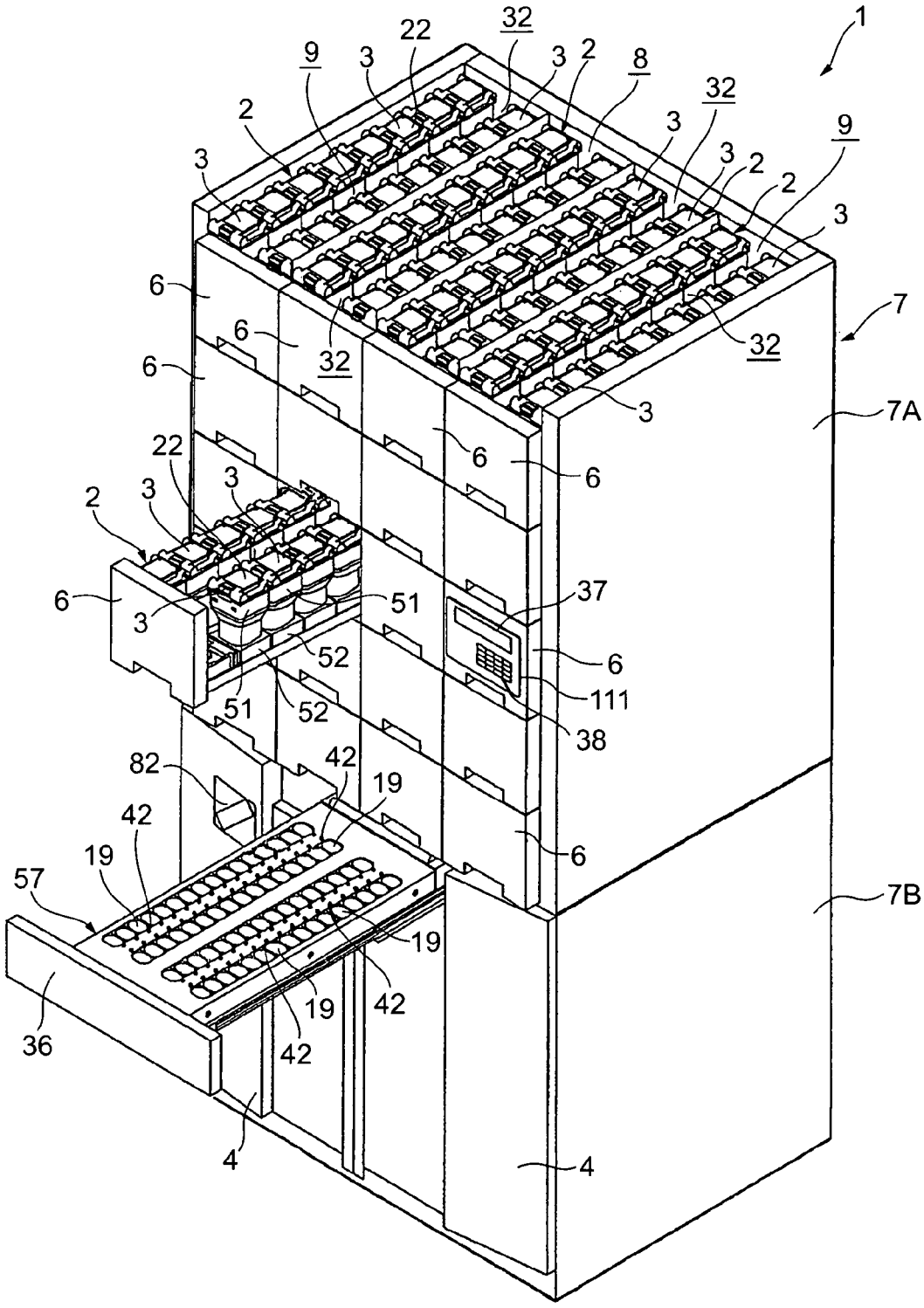
FIG. 1 is a perspective view of a medicine supply apparatus (excluding a top plate) of a preferred embodiment of the present invention.

Now, a preferred embodiment of the present invention will be described in detail with reference to the drawings.

A medicine supply apparatus 1 of the embodiment is installed in a hospital, a pharmacy, or the like, and comprises a main body 7 having a laterally long rectangular shape, and a later-described personal computer PC for control. The main body 7 comprises an upper structural body 7A and a lower structural body 7B that are mutually separable from each other, and is configured that the upper structural body 7A is placed on the lower structural body 7B and joined thereto.

The upper structural body 7A is provided therein with a case receiving portion 8 that is open on its front, upper, and lower sides for receiving therein tablet cases 3 . . . , and the top surface of the case receiving portion 8 is closed by a detachable top plate 1A.

The lower structural body 7B is open on its front and upper sides, and communicates with the upper structural body 7A on the upper side thereof. A later-described packing machine 13 as filling means is received and disposed in the lower structural body 7B. The opening of the lower structural body 7B on the front side thereof is openably closed by lower panels 4, 4 serving as double swinging doors.

In the case receiving portion 8 of the upper structural body 7A, shelves 2 . . . are erected in four columns laterally and in five rows vertically (20 shelves in total). A door panel 6 is attached to the front end of each shelf 2 and, in the state where all the shelves 2 . . . are received in the case receiving portion 8, the door panels 6 close the front side opening of the upper structural body 7A (case receiving portion 8). In the middle of each shelf 2, a path 9 that is open on its upper and lower sides is formed so as to extend in a forward/backward direction. Drive bases 52 of the tablet cases 3 are mounted on both lateral sides (left and right sides) of the path 9, such that 8 drive bases are arrayed in the forward/backward direction on each side and 16 drive bases in total are arranged in parallel on both sides. Each tablet case 3 comprises the drive base 52 and a container 51 attached thereon.

Figure 12:
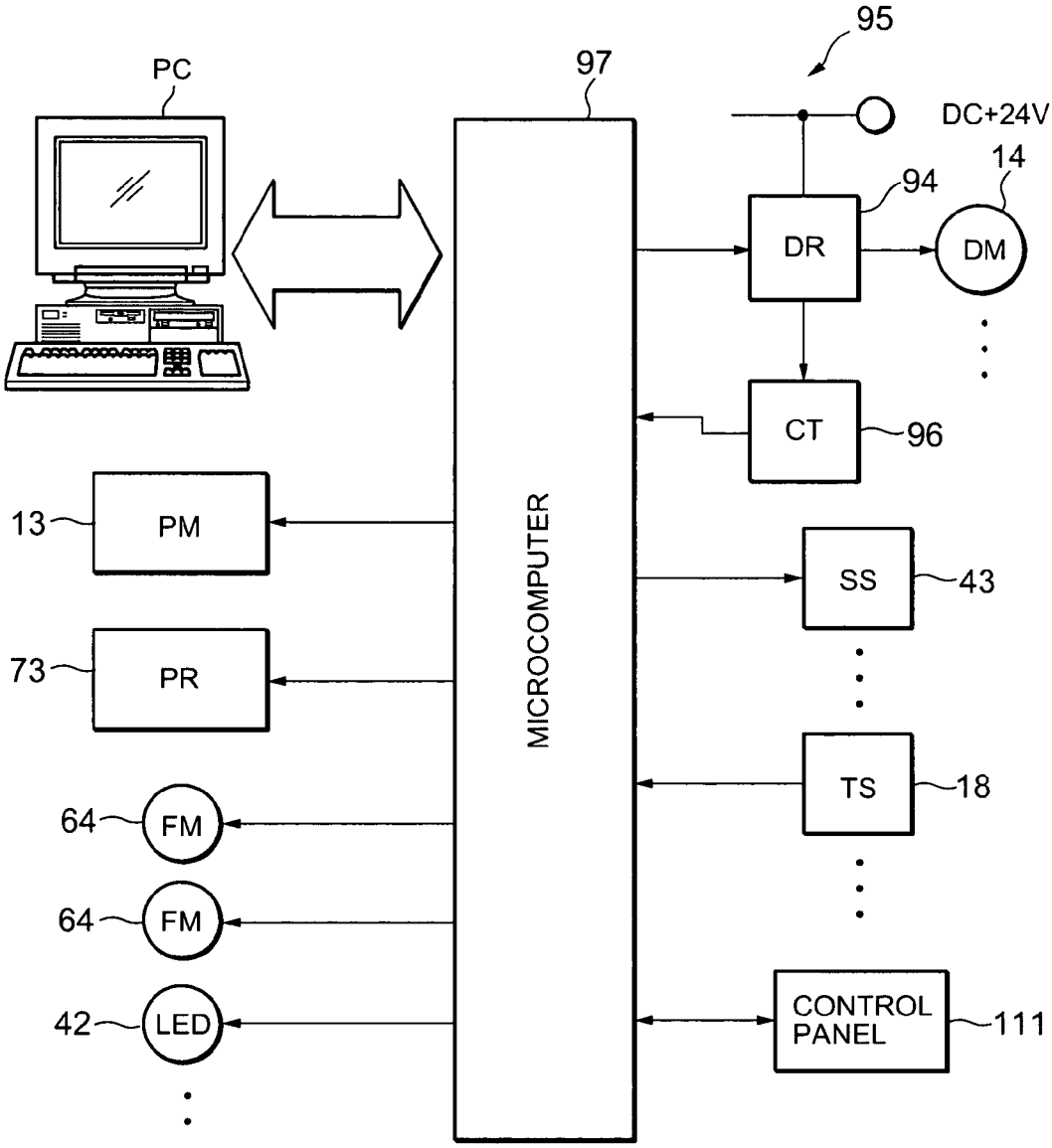
FIG. 12 is a block diagram showing an electrical circuit of a controller of the medicine supply apparatus of FIG. 1.

In the drive base 52, there are mounted a drum motor 14 as a drum driving motor comprising a dc brushed motor, and an optical medicine detection sensor 18 for detecting a medicine discharged from the tablet case 3 (see FIG. 12). On the other hand, the container 51 of the tablet case 3 is open on its upper side, and this opening is openably closed by a cover 22. Further, a discharge drum (not shown) is mounted in the container 51 at the bottom thereof, and a plurality of vertical grooves are formed on the circumference of the discharge drum at predetermined intervals. Medicines are filled into the container 51 from the upper side opening (the cover 22 is opened), and enter each vertical groove of the discharge drum per two.

The container 51 is placed on the drive base 52 and detachably attached thereto, so that the tablet case 3 is constituted. In this event, the discharge drum disengageably engages with a drive shaft of the drum motor 14. Then, when the drum motor 14 is driven forward, the discharge drum is rotated forward so that the vertical grooves thereof coincide with a discharge port (not shown) of the drive base 52 in order, to thereby discharge the medicines one by one. These discharged medicines are detected by the medicine detection sensor 18.

Each shelf 2 mounted with the tablet cases 3 . . . is detachably screwed to a pair of left and right drawing rails 27, 27 mounted in the case receiving portion 8 of the upper structural body 7A. Thereby, each shelf 2 and the tablet cases 3 . . . attached thereto are drawably received in the case receiving portion 8 and, in the drawn state, the shelf 2 is detachable from the drawing rails 27, 27 and attachable thereto.

A harness 28 is detachably attached to the rear end of each shelf 2 for energizing (power feeding) the drum motors 14 of the tablet cases 3 . . . and transmitting outputs from the medicine detection sensors 18 thereof. The harness 28 has a length longer than a drawing distance of the shelf 2.

In the state where the respective shelves 2 . . . are received in the case receiving portion 8, the paths 9 of the shelves 2 located vertically correspond to each other to thereby form a continuous chute 32 communicating vertically. Consequently, in this embodiment, four chutes 32 . . . each extending vertically are laterally arranged in the case receiving portion 8. In as much as the independently drawable shelves 2 . . . arrayed in a plurality of rows vertically are provided in the case receiving portion 8 as described above, exchange of the containers 51 of the tablet cases 3 can be carried out by drawing each shelf 2. Thereby, as compared with a structure where the respective shelves 2 . . . vertically arrayed in one column are simultaneously drawn out, an interval that should be defined between the vertically adjacent shelves 2, 2 for exchanging the containers 51 can be reduced, and therefore, the number of the tablet cases 3 that can be received in the case receiving portion 8 can be raised. Further, inasmuch as the path 9 is formed in the middle of each shelf 2 so as to form the chute 32 extending vertically in the state where the shelves 2 are vertically received in the case receiving portion 8, an interval between the chutes 32, 32 located at the left and right ends can be shortened as compared with a case where chutes are formed at side portions of the shelves 2. Thereby, it becomes possible to diminish upper side opening areas of shutters 53, 53 and a hopper 54, which will be described later, to thereby achieve size reduction.

Figure 3:
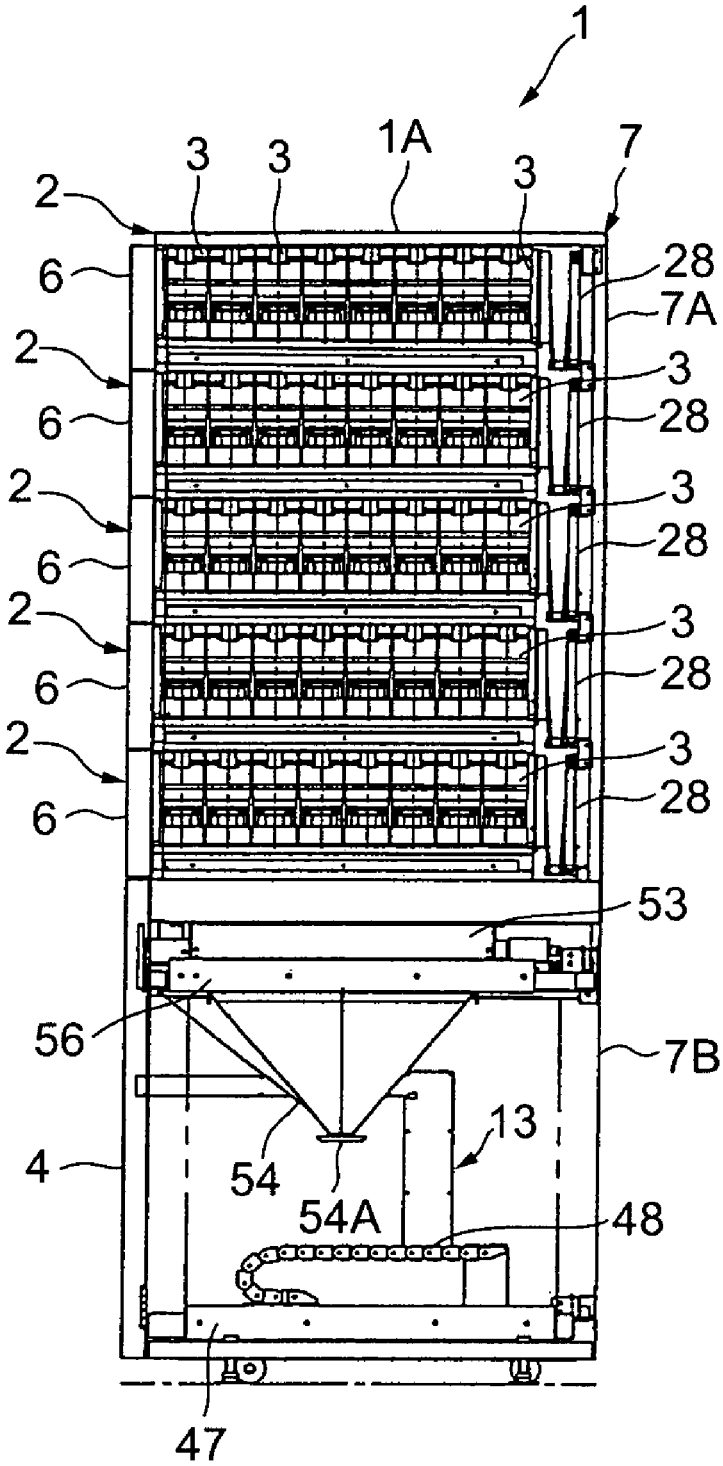
FIG. 3 is a longitudinal sectional side view of the medicine supply apparatus of FIG. 1.
Figure 4:
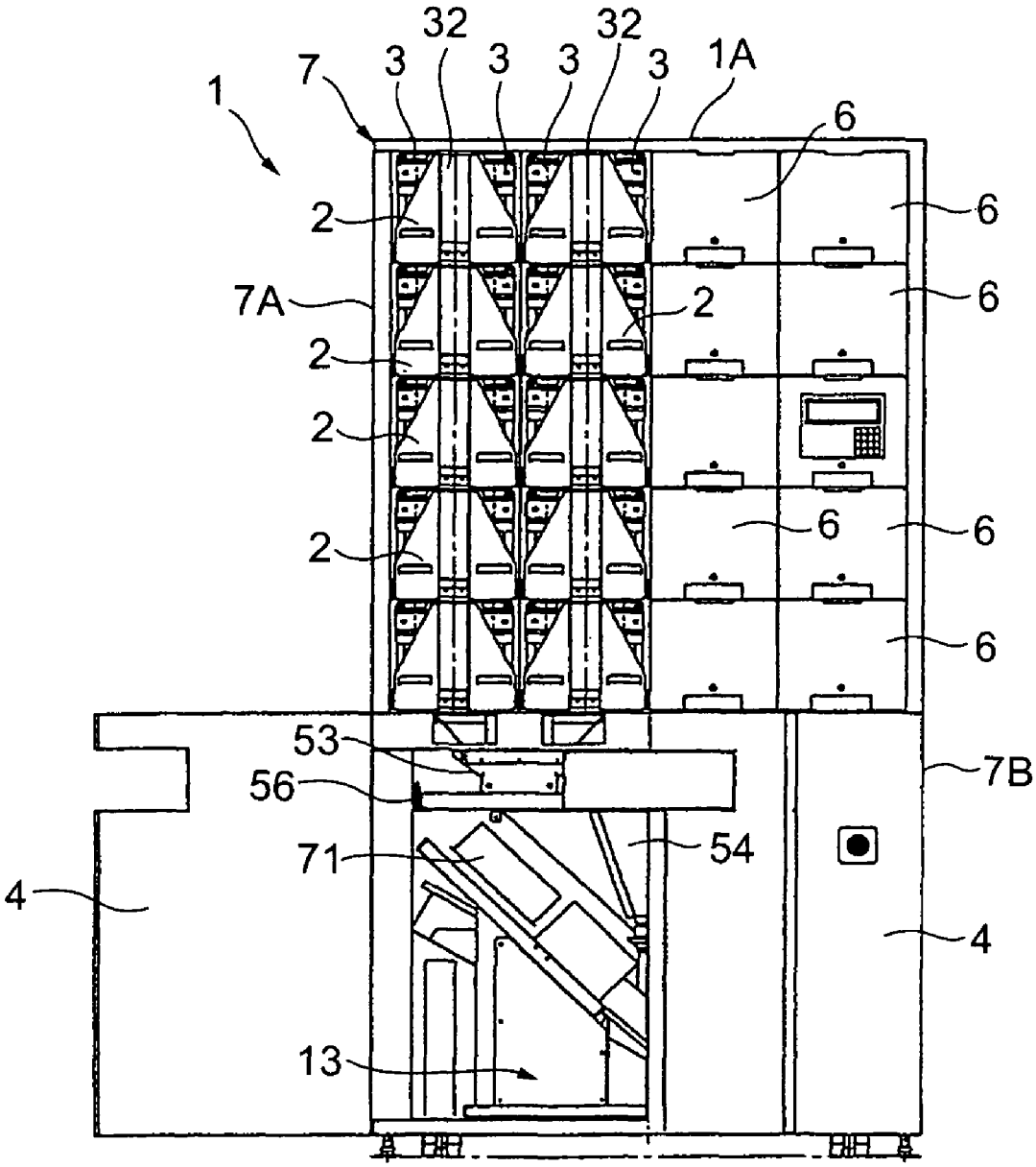
FIG. 4 is another front view of the medicine supply apparatus of FIG. 1.

On the other hand, in the lower part of the lower structural body 7B of the main body 7, the packing machine 13 (filling means) is disposed as described before. The packing machine 13 is, as shown in FIG. 3, detachably screwed to drawing rails 47, 47 mounted in the lower structural body 7B at the bottom thereof on the left and right sides. Thereby, the packing machine 13 can be drawn forward from the inside of the lower structural body 7B in the state where the lower panels 4, 4 are opened, and further, in the drawn state, the packing machine 13 is detachable from the drawing rails 47, 47 and attachable thereto. Incidentally, numeral 48 denotes a harness for the packing machine, which is detachably connected via connectors between the packing machine 13 and the lower structural body 7B. The harness has a length that can allow a sufficient drawing amount of the packing machine 13.

Figure 2:
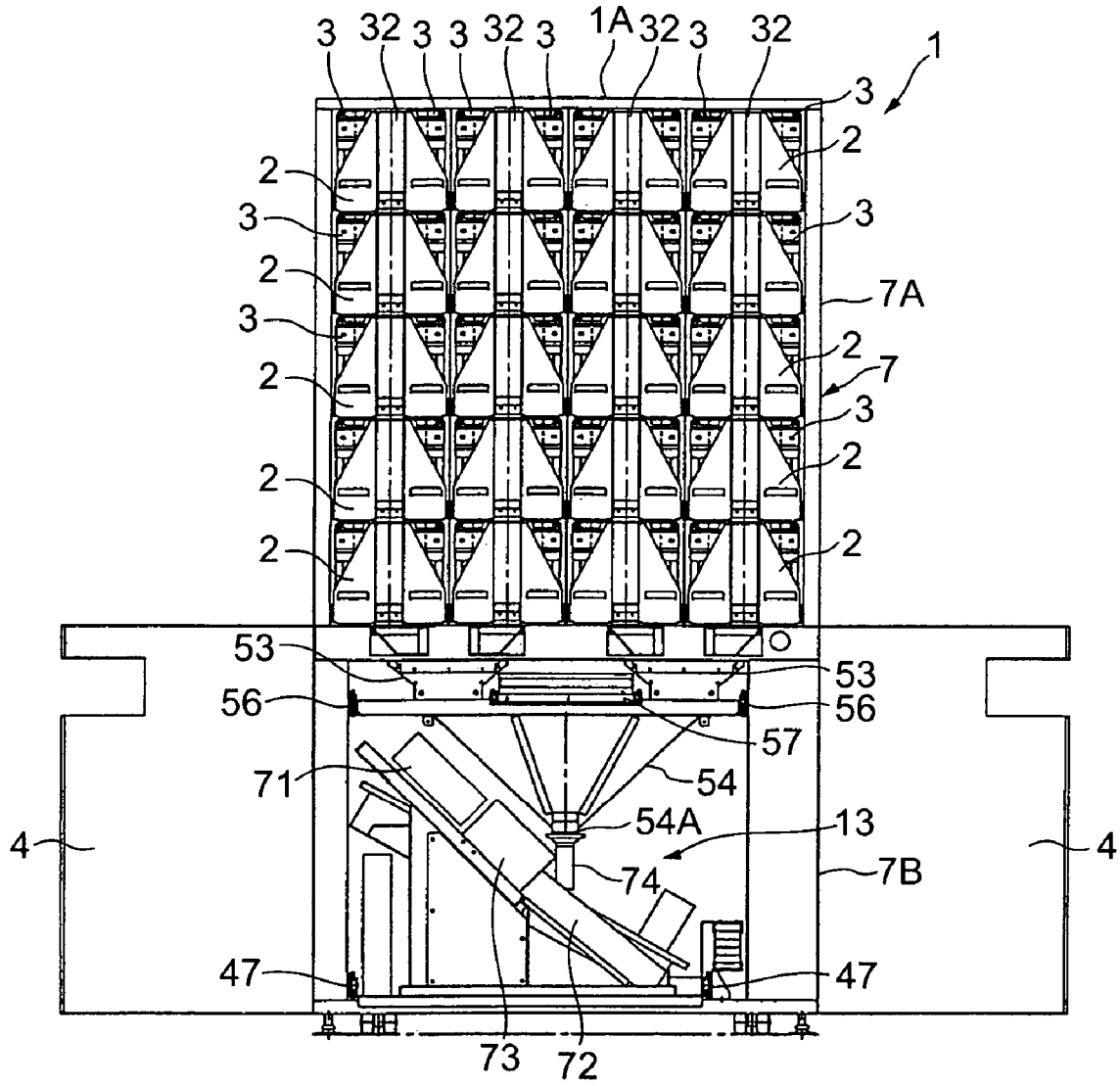
FIG. 2 is a front view of the medicine supply apparatus of FIG. 1 in the state where door panels of respective shelves are removed and lower panels are opened.

In the upper part of the lower structural body 7B, two shutters 53, 53 are laterally provided. The shutters 53, 53 are located so as to correspond to the downward directions of the foregoing chutes 32 . . . located over the shutters 53, 53. Specifically, in FIG. 2, the shutter 53 on the right as facing the drawing sheet corresponds to the chute 32 on the rightmost side as facing the drawing sheet and the chute 32 adjacent thereto, and the shutter 53 on the left as facing the drawing sheet corresponds to the chute 32 on the leftmost side as facing the drawing sheet and the chute 32 adjacent thereto. The shutters 53, 53 serve to temporarily receive medicines dropping into the later-described hopper 54 from the respective chutes 32 . . . .

The hopper 54 is provided in the lower structural body 7B at a position corresponding to the downward directions of the shutters 53, 53. The hopper 54 has a rectangular funnel shape opening wider toward the upper side and narrowing toward the lower end, and serves to receive the medicines having dropped from the chutes 32 . . . and passed through the shutters 53, 53 and discharge them from a lower end opening 54A.

Figure 5:
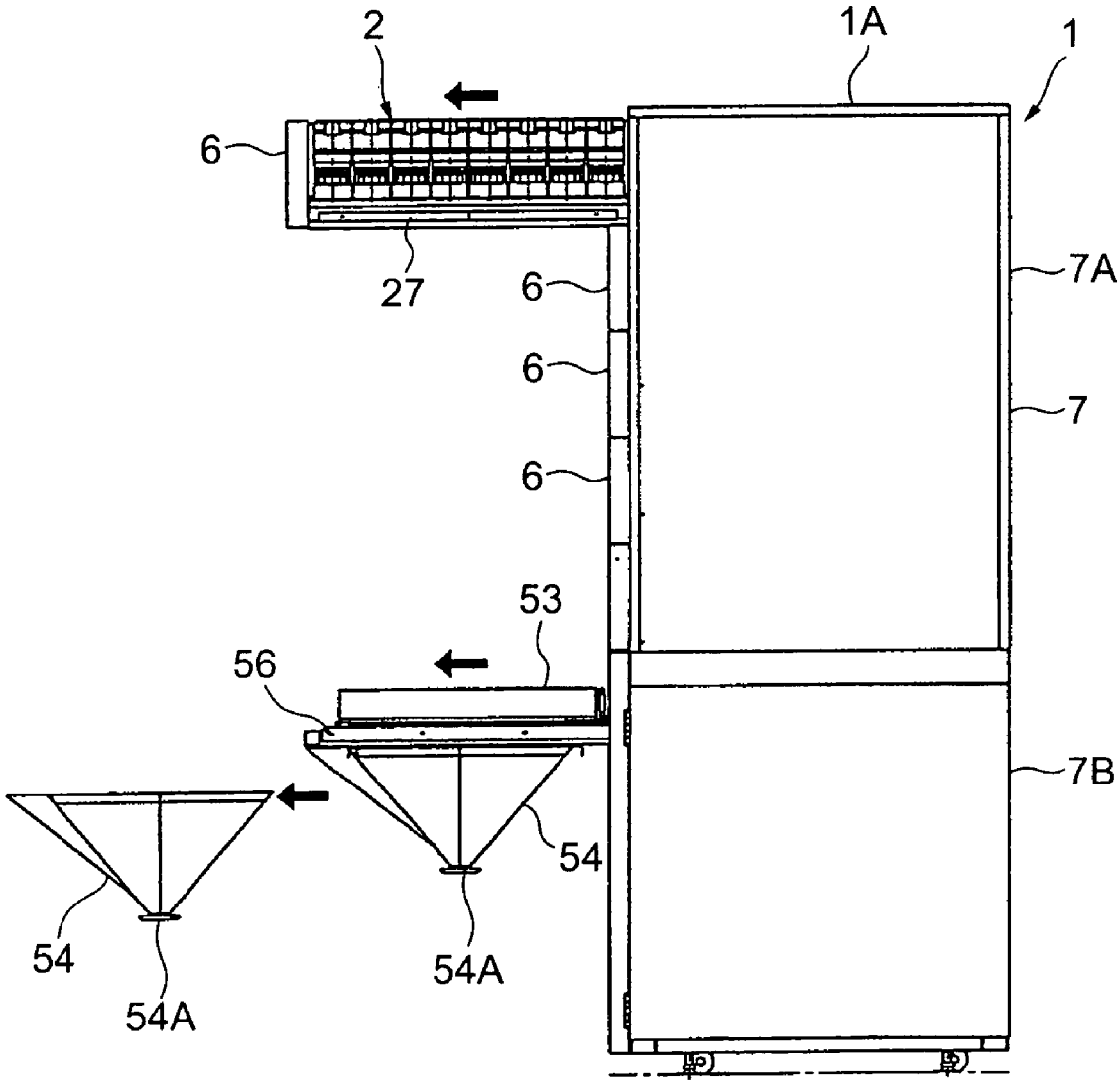
FIG. 5 is a side view of the medicine supply apparatus of FIG. 1.

The left and right upper ends of the hopper 54 are detachably screwed to drawing rails 56, 56 attached to left and right upper portions within the lower structural body 7B. The shutters 53, 53 are located on the upper side of the drawing rails 56, 56 and also detachably screwed to the drawing rails 56, 56, respectively. Thereby, the hopper 54 and the shutters 53, 53 are simultaneously drawable forward from the inside of the lower structural body 7B in the state where the lower panels 4, 4 are opened, and further, in the drawn state, the hopper 54 and the shutters 53, 53 are detachable from the drawing rails 56, 56 and attachable thereto (see FIG. 5).

With the structure as described above, when carrying out the maintenance, such as exchange of the tablet cases 3, cleaning of the chutes 32 . . . each formed by the paths 9, and the hopper 54, or exchange of parts of the packing machine 13, attaching/detaching operations can be implemented while they are drawn out from the upper structural body 7A or the lower structural body 7B of the main body 7.

Thereby, it becomes possible to remarkably improve the operability of maintenance of the medicine supply apparatus 1 so as to realize smooth medicine filling. Particularly, inasmuch as the plurality of tablet cases 3 can be simultaneously drawn out from the upper structural body 7A together with the shelf 2, and further, the containers 51 of the tablet cases 3 are detachably attached, the operability of exchange of the containers 51 of the tablet cases 3 can be further improved.

Moreover, since the shutters 53, 53 can also be drawn out from the lower structural body 7B and are detachably attached, it also becomes possible to improve the operability of maintenance of the shutters 53, 53 that serve to temporarily receive the medicines dropping into the hopper 54. Particularly, inasmuch as the shutters 53, 53 and the hopper 54 are attached so as to be simultaneously drawable from the lower structural body 7B, it becomes possible to further improve the operability upon carrying out the maintenance of the shutters 53, 53 and the hopper 54.

Figure 6:
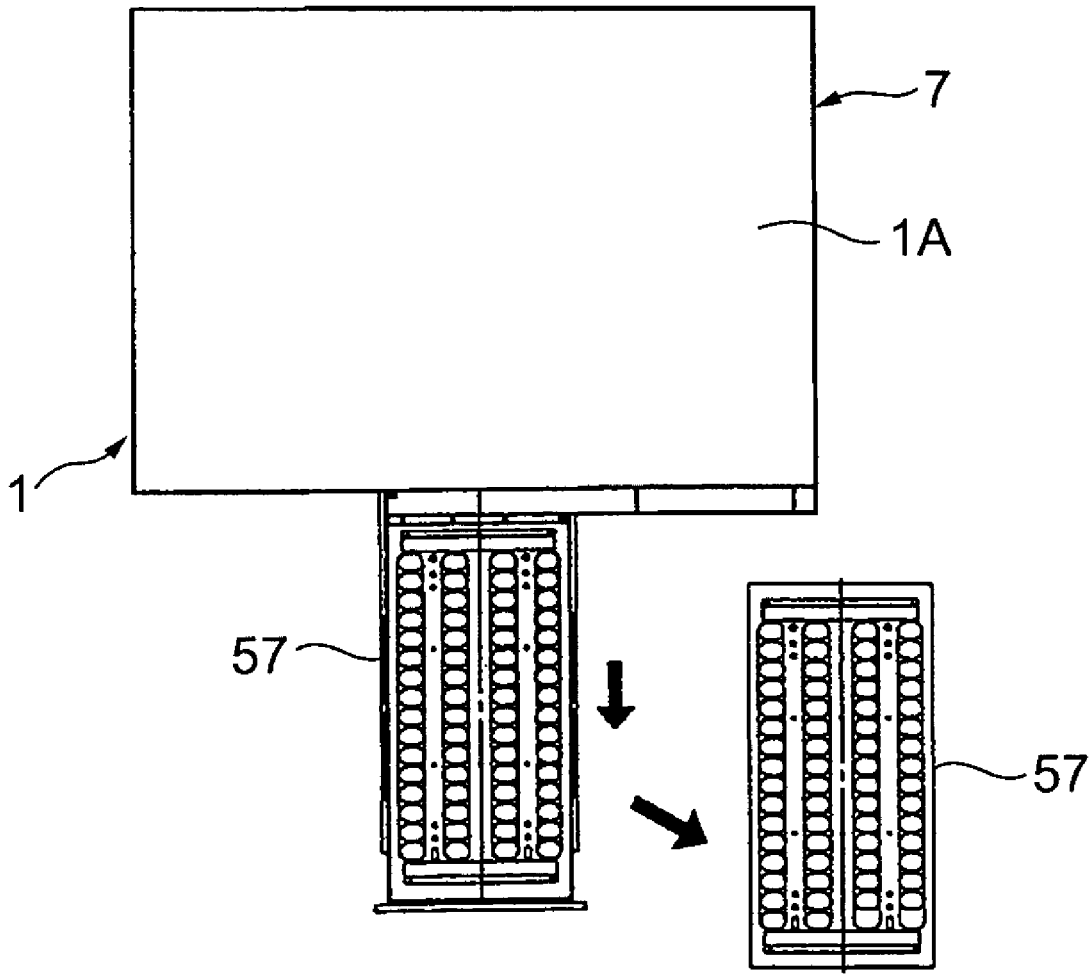
FIG. 6 is a plan view of the medicine supply apparatus of FIG. 1.

In the middle of the upper part within the lower structural body 7B, a medicine feeder (UTC) 57 is mounted between the shutters 53, 53. The medicine feeder 57 is not covered with the lower panels 4, 4 and can be independently drawn out forward, and further, is detachably attached (see FIGS. 1 and 6). The medicine feeder 57 is a feeder for arbitrarily supplying additional medicines, and comprises a plurality of reception compartments 19 . . . movably arranged in two lines on a base 16, feeder motors 64, 64 (forming discharge means) each for moving the reception compartments 19 . . . in the corresponding line, and a cover 21 covering them (see FIGS. 7 to 10).

Figure 9:
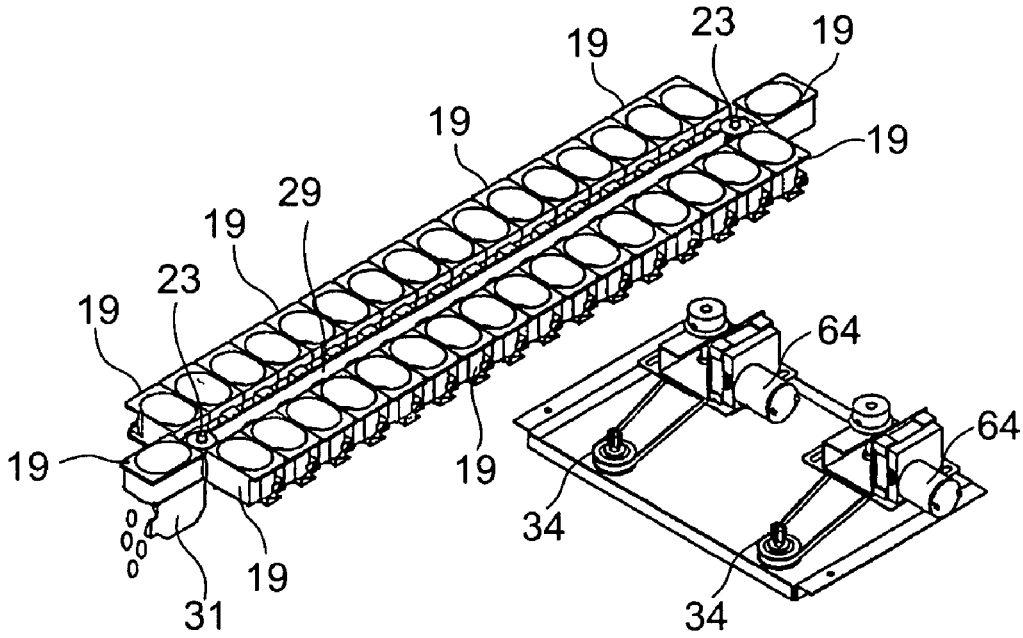
FIG. 9 is a diagram showing an internal structure of the medicine feeder of FIG. 7.
Figure 10:
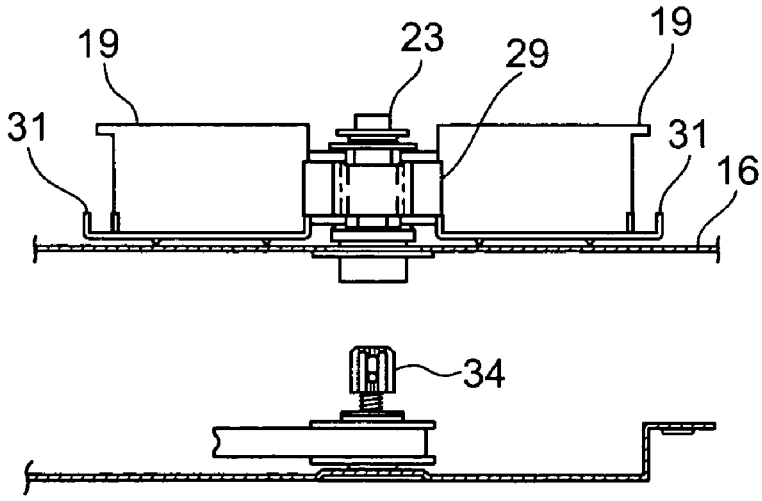
FIG. 10 is a sectional view of the internal structure of the medicine feeder of FIG. 7.

Four rotation shafts 23, 23, 23, 23 in total are erected on the base 16 and arranged in longitudinal (forward/backward) and lateral (leftward/rightward) directions. Belts 29, 29 (two lines laterally) are extended over two pairs of longitudinally corresponding rotation shafts 23, 23, respectively (only one belt 29 and one pair of rotation shafts 23, 23 are shown in FIG. 9). Further, 34 reception compartments 19 . . . are attached to an outer surface of the belt 29 of each line. Each of the reception compartments 19 . . . is open on its upper side, and a medicine can be put into the reception compartment 19 through this opening. Further, each reception compartment 19 is attached on its lower side with a shutter 31, forming discharge means, which rotates downward to open the reception compartment 19 on its lower side.

The cover 21 is formed on its upper side with window holes 33 . . . arranged in four lines laterally and each extending in the forward/backward direction. The window holes 33 correspond to the reception compartments 19 . . . located at straight portions of the belts 20 of the respective lines. Thereby, the upper side openings of 16 reception compartments 19 . . . are exposed to each window hole 33. Further, each of drive shafts 34, 34 respectively driven by the feeder motors 64, 64 engages with the rotation shaft 23 over which the belt 29 of the corresponding line is laid. Therefore, when the feeder motor 64 is rotated, the belt 29 is driven to move the reception compartments 19 . . . attached thereto. Then, the shutter 31 of the reception compartment 19 moved to the rear end (the front end in FIG. 9) is opened so that medicines therein are discharged and drop into the hopper 54.

Further, the cover 21 is provided with LED lamps 42 as display means, forming guide means, which are arranged along the window holes 33 . . . so as to correspond to the reception compartments 19 exposed upward through the window holes 33 . . . . Each LED lamp 42 is turned on to show a user the reception compartment 19 that should receive the medicine. Accordingly, the number of the LED lamps 42 corresponds to the number of the reception compartments 19 . . . exposed through the window holes 33 . . . , that is, 16×4=64. Incidentally, numeral 36 denotes a door attached to the front end of the medicine feeder 57.

Figure 11:
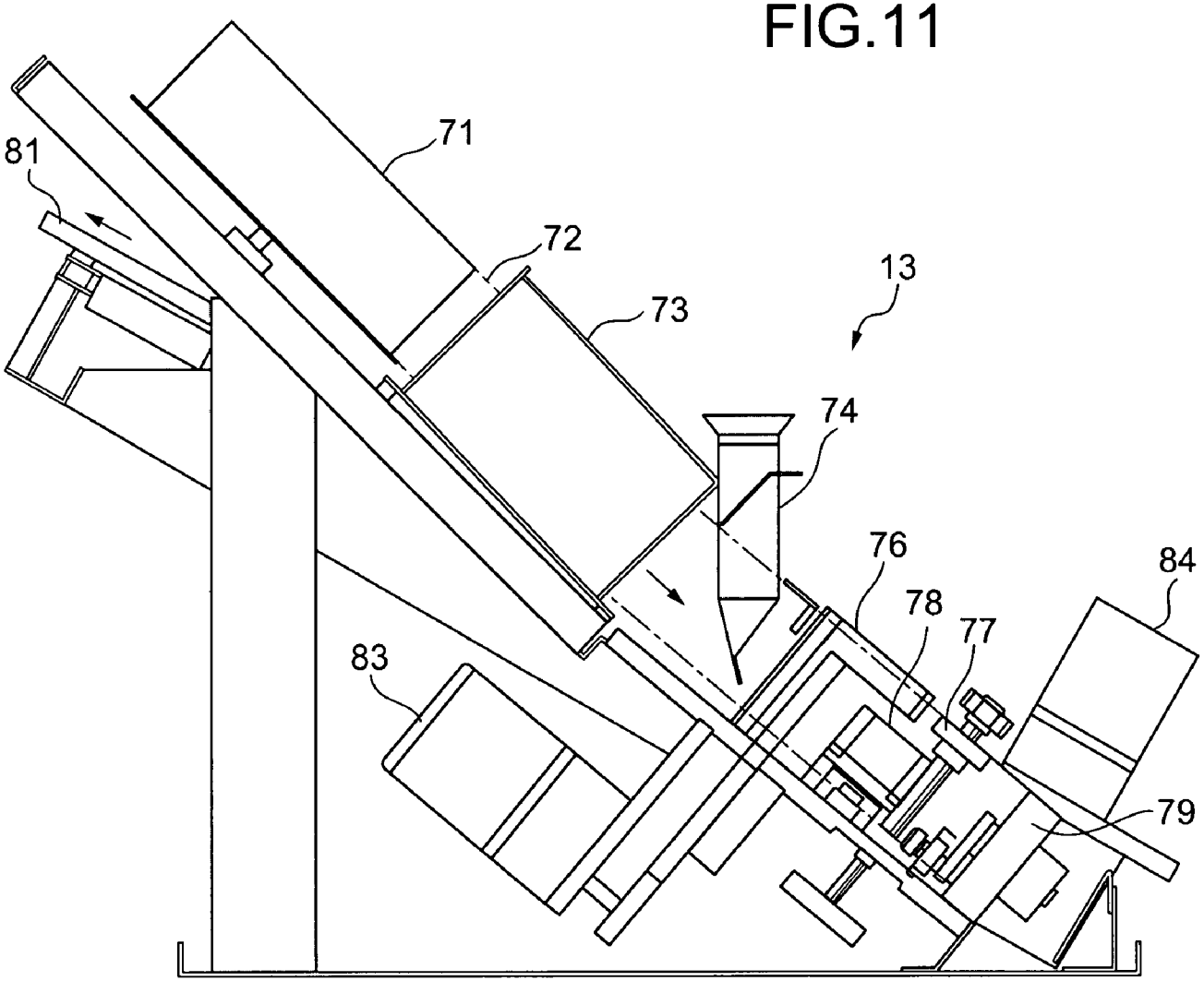
FIG. 11 is a front view of a packing machine of the medicine supply apparatus of FIG. 1.

Now, referring to FIG. 11, the structure of the foregoing packing machine 13 will be described. Numeral 71 denotes a roll of heat-weldable packing paper 72 (forming containers), 73 a printer, 74 a nozzle attached to the lower end opening 54A of the hopper 54, 76 a heat seal head made of silicon rubber, 77 a roller for conveying the packing paper 72 drawn out from the roll 71, 79 a cutter for cutting the packing paper 72, and 81 a conveyor for conveying the packing paper 72, partitioned per pack and then cut, to a takeout port 82 provided at the lower panel 4. The conveyor 81 is continuously provided along the conveying route of the packing paper 72. Numeral 83 denotes a motor for driving the heat seal head 76, 78 a motor for driving the roller 77, and 84 a motor for driving the conveyor 81.

The packing paper 72 rolled into the roll 71 has a substantially V-shape in cross section, i.e. the packing paper 72 is open on its upper side and folded at its lower end. The packing paper 72 is pulled out obliquely downward toward the right as facing the drawing sheet, thereafter, printing is performed on the surface thereof by the printer 73. Then, medicines discharged from the nozzle 74 are projected into the packing paper 72, and the packing paper 72 is partitioned per pack due to heat welding by the heat seal head 76. The packing paper 72 partitioned per pack is then cut by the cutter 79, and conveyed by the conveyor 81 to the takeout port 82 located left-upward as facing the drawing sheet.

FIG. 12 is a block diagram showing an electrical circuit of a controller 95 of the medicine supply device 1. The controller 95 is formed by a general purpose microcomputer 97 forming control means. To outputs of the microcomputer 97 are connected the drum motors 14 . . . of the tablet cases 3 . . . via a driver circuit 94, the packing machine 13, the printer 73, shutter solenoids 43 . . . for opening/closing the shutters 31 . . . , the feeder motors 64, 64, and the LED lamps 42 . . . . The microcomputer 97 controls the driver circuit 94 to apply dc 24V voltage to the drum motors 14 . . . to thereby rotate them forward and backward, respectively.

To inputs of the microcomputer 97 are connected outputs of a current transformer 96 that detects energizing currents of the respective drum motors 14 . . . , and outputs of the respective medicine detection sensors 18 . . . . Further, the microcomputer 97 is connected to the foregoing personal computer PC for data communication.

A control panel 111 is attached to one of the door panels 6. The control panel 111 is provided with a liquid crystal display 37 forming a display, and operation switches 38 forming input means, which are also connected to the microcomputer 97.

Now, an operation of the medicine supply apparatus 1 of the present invention having the foregoing structure will be described. It is assumed that the foregoing shutters 53, 53, 31 . . . are closed when the power is turned on. It is further assumed that the shelves 2 . . . attached with the tablet cases 3 . . . containing predetermined medicines, respectively, are mounted in the case receiving portion 8 of the upper structural body 7A as described before.

At the outset, an operation of medicine preparation will be described. When an operator inputs prescription data from the personal computer PC based on a prescription by a doctor, the microcomputer 97 of the medicine supply apparatus 1 identifies the tablet case 3 containing therein specified medicines based on the inputted prescription data, rotates forward the drum motor 14 thereof via the driver circuit 94 to rotate forward the discharge drum, thereby to discharge the medicines in the vertical groove one by one.

In this event, the microcomputer 97 receives a medicine detection signal from the medicine detection sensor 18, and counts the discharged medicines. Then, when a predetermined quantity of the medicines is discharged, the drum motor 14 is stopped. The discharged medicines enter the chute 32 formed by the paths 9, then are temporarily received by the shutter 53.

Then, the microcomputer 97 opens the shutter 53 to drop the medicines into the hopper 54, and projects the medicines into the packing paper 72 via the nozzle 74. Then, after packing the medicines by the use of the packing machine 13 as described before, the packed medicines are offered to the exterior from the takeout port 82. In this event, by carrying out discharge of the next medicines at a time instant when the medicines dropped into the hopper 54 from the shutter 53, the microcomputer 97 shortens a time required for the packing. Further, the foregoing printing about the medicines to be packed is implemented by the printer 73 before the medicines are projected.

Now, an operation of the medicine feeder 57 will be described. The medicine feeder 57 is used for packing medicines that are not contained in the tablet cases 3 . . . , i.e. that are not prescribed very often, or packing medicines in addition to medicines from the tablet case. Data about medicines to be packed by the medicine feeder 57 is also sent from the personal computer PC as being included in the foregoing prescription data.

Now, it is assumed that there are tablets A, B, C, and D as medicines to be packed using the medicine feeder 57, and the quantities of the tablets A, B, C, and D to be taken at the respective taking times, i.e. morning, noon, evening, and before going to bed, are like prescription data as shown in FIG. 13. FIG. 13 shows the prescription data for one week, wherein the prescription is the same on Sunday, Tuesday, Wednesday, Friday, and Saturday, while it differs on Monday and Thursday (e.g. dialysis days).

Upon reception of such prescription data for the medicine feeder 57, the microcomputer 97 first shows an indication as illustrated in FIG. 14 on the liquid crystal display 37 of the control panel 111. In this case, the tablets A to D are displayed in a vertical array, and quantities of them per dose are displayed on the right side thereof. At the outset, the microcomputer 97 displays a mark * on the left side of the tablet A in the uppermost row, and turns on the LED lamps 42 . . . corresponding to the reception compartments 19 of the medicine feeder 57 into which the tablets A should be fed. It is assumed that the medicine feeder 57 has already been drawn out by a user.

Figure 7:
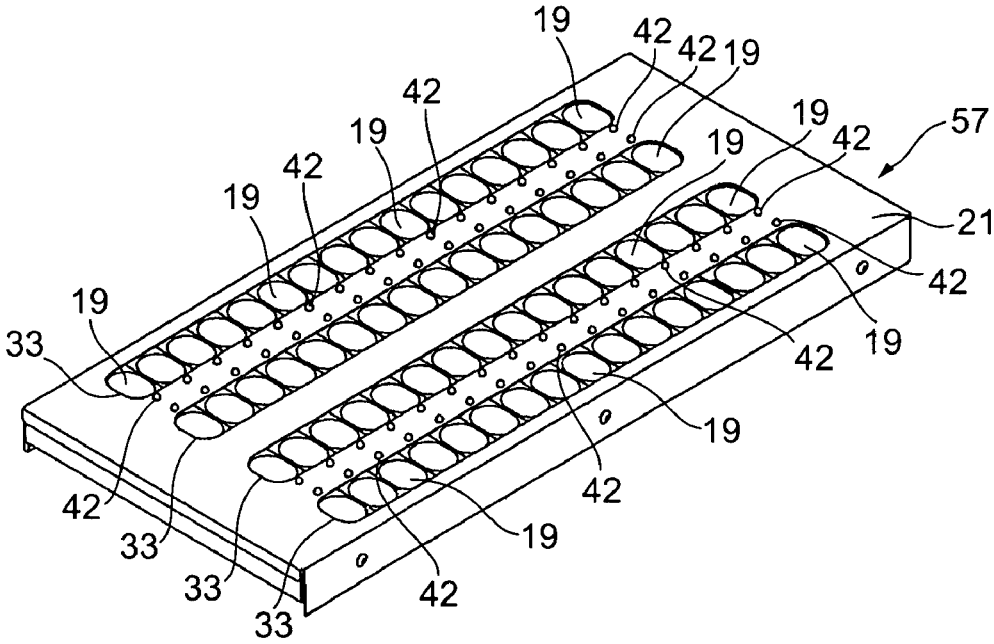
FIG. 7 is a perspective view of a medicine feeder of the medicine supply apparatus of FIG. 1.
Figure 8:
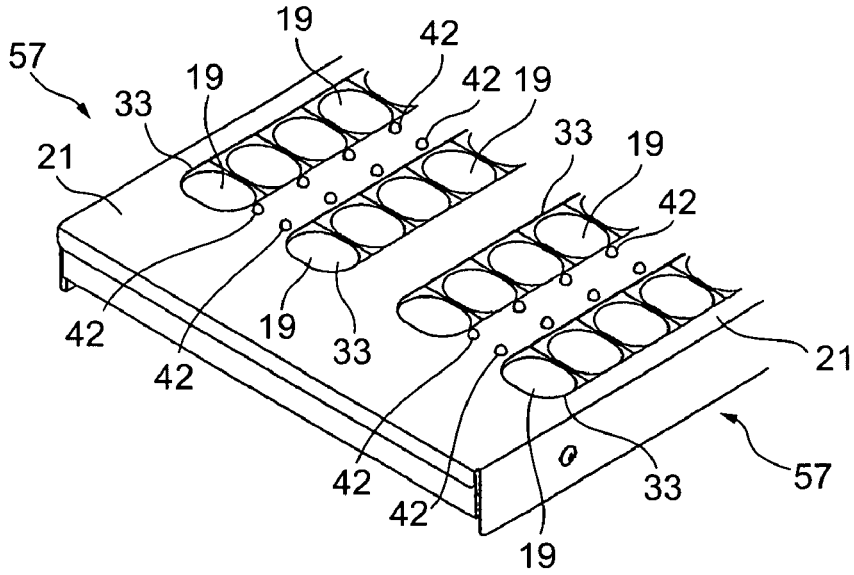
FIG. 8 is an enlarged perspective view of a front portion of the medicine feeder of FIG. 7.

In this case, for example, assuming that the reception compartments 19 . . . attached to the belt 29 in the right line as facing FIG. 7 are used, the microcomputer 97 turns on the LED lamps 42 . . . corresponding to the third reception compartment 19 from the right end deepest side, the fourth reception compartment 19 therefrom toward this side, the fourth reception compartment 19 therefrom further toward this side, the fourth reception compartment 19 therefrom further toward this side, the second reception compartment 19 of the left array from this most side, the fourth reception compartment 19 therefrom toward the deeper side, and the fourth reception compartment 19 therefrom further toward the deeper side, according to the prescription data of FIG. 13. The user puts the tablets A into the reception compartments 19 . . . where the corresponding LED lamps 42 . . . are turned on, one tablet A for each reception compartment 19.

Subsequently, when feeding the tablets B into the reception compartments 19, the user operates the operation switches 38 of the control panel 111 to move the mark * to the one-row below indication of the tablet B. Then, the microcomputer 97 once turns off the LED lamps 42 . . . that have been turned on up to then, and turns on the LED lamps 42 . . . corresponding to the first, second, and third reception compartments 19, 19, 19 from the right end deepest side, the fourth reception compartment 19 therefrom toward this side, the second reception compartment 19 therefrom further toward this side, the first reception compartment 19 therefrom further toward this side, the first reception compartment 19 therefrom further toward this side, the second reception compartment 19 therefrom further toward this side, the first reception compartment 19 therefrom further toward this side, the first reception compartment 19 therefrom further toward this side, the second reception compartment 19 of the left array from this most side, the second reception compartment 19 therefrom toward the deeper side, the first reception compartment 19 therefrom further toward the deeper side, the first reception compartment 19 therefrom further toward the deeper side, the second reception compartment 19 therefrom further toward the deeper side, the first reception compartment 19 therefrom further toward the deeper side, and the first reception compartment 19 therefrom further toward the deeper side. The user puts the tablets B into the reception compartments 19 . . . where the corresponding LED lamps 42 . . . are turned on, one tablet B for each reception compartment 19.

Subsequently, when feeding the tablets C into the reception compartments 19, the user operates the operation switches 38 of the control panel 111 to move the mark * to the further one-row below indication of the tablet C. Then, the microcomputer 97 once turns off the LED lamps 42 . . . that have been turned on up to then, and turns on the LED lamps 42 . . . corresponding to the first reception compartment 19 from the right end deepest side, the second reception compartment 19 therefrom toward this side, the fourth reception compartment 19 therefrom further toward this side, the second reception compartment 19 therefrom further toward this side, the second reception compartment 19 therefrom further toward this side, the second reception compartment 19 therefrom further toward this side, the second reception compartment 19 therefrom further toward this side, the second reception compartment 19 of the left array from this most side, the second reception compartment 19 therefrom toward the deeper side, the second reception compartment 19 therefrom further toward the deeper side, the second reception compartment 19 therefrom further toward the deeper side, and the second reception compartment 19 therefrom further toward the deeper side. The user puts the tablets C into the reception compartments 19 . . . where the corresponding LED lamps 42 . . . are turned on, two tablets C for each reception compartment 19.

Subsequently, when feeding the tablets D into the reception compartments 19, the user operates the operation switches 38 of the control panel 111 to move the mark * to the further one-row below indication of the tablet D. Then, the microcomputer 97 once turns off the LED lamps 42 . . . that have been turned on up to then, and turns on the LED lamps 42, 42 corresponding to the seventh reception compartment 19 from the right end deepest side, and the second reception compartment 19 of the left array from this most side. The user puts the tablets D into the reception compartments 19, 19 where the corresponding LED lamps 42, 42 are turned on, one tablet D for each reception compartment 19.

Thereby, the tablets A to D in the combinations shown in FIG. 13 are put into the reception compartments 19 . . . in the right line according to the respective taking times. Thereafter, when the user pushes the medicine feeder 57 into the lower structural body 7B, the microcomputer 97 drives the feeder motor 64 to move the reception compartments 19 . . . in the right line counterclockwise to thereby place them at the rear end one by one. Then, the microcomputer 97 opens the shutter 31 of the reception compartment 19 located at the rear end by the use of the shutter solenoid 43 to drop the tablets inside into the hopper 54, and packs the tablets per reception compartment 19 by the use of the packing machine 13 as described before. Incidentally, the empty reception compartments 19 are moved in a skipped manner without opening the shutters 31.

As described above, since it is configured that the microcomputer 97 shows, based on the prescription data, the reception compartments 19 . . . to be fed with the medicines (tablets A to D) using the LED lamps 42 . . . , the user can easily and securely put the medicines into the reception compartments 19 . . . that should receive the medicines. Thereby, it becomes possible to improve the usability and securely prevent occurrence of wrong preparation of the medicines.

Further, inasmuch as the indication of the reception compartments 19 . . . to be fed with the medicines is switched depending on the kind of medicine (tablets A to D), the operability becomes highly excellent even when feeding a plurality of kinds of medicines into different reception compartments 19 in a mixed manner.

Further, inasmuch as the reception compartments 19 . . . to be fed with the medicines are identified by lighting of the LED lamps 42 . . . provided correspondingly to the reception compartments 19 . . . , the user can definitely discriminate the reception compartments 19 to be fed with the medicines from the others. Thereby, it becomes possible to further improve the usability and reliability.

In the foregoing embodiment, the input of data into the medicine supply apparatus 1 is carried out using the separate personal computer PC. However, the present invention is not limited thereto. Instead of the personal computer PC or in addition thereto, the data input may be implemented using the control panel 111. Further, in the foregoing embodiment, the present invention is applied to the medicine supply apparatus that is provided with the plurality of tablet cases 3 . . . and packs the medicines discharged therefrom. However, the present invention is not limited thereto. The present invention is also applicable to a medicine supply apparatus provided with only the medicine feeder 57.

Further, in the foregoing embodiment, the medicine feeder 57 is of the belt driven type. However, the present invention is not limited thereto. The respective shutters 31 may be controlled to be opened and closed without moving the reception compartments 19 . . . . Moreover, in the invention of claim 1 or 2, guide means is not limited to controlling the lighting of the LED lamps. Specifically, it may also be arranged that, for example, covers for opening/closing the upper side openings of the reception compartments 19 are provided, respectively, and the guide means switchingly opens the covers of the reception compartments 19 to be fed with the medicines, thereby to identify such reception compartments 19. Further, although the medicines are filled into the packing paper in the foregoing embodiment, the present invention is not limited thereto, but is also applicable to a case where the medicines are filled into vials or the like per dose.

As described above in detail, according to the present invention, a medicine supply apparatus comprises a plurality of reception compartments into which medicines can be respectively put arbitrarily, discharge means for discharging the medicines in the reception compartments, respectively, and filling means for filling the medicines discharged from the reception compartments into containers such as bags or vials, and further comprises guide means for identifiably showing the plurality of reception compartments, respectively, and control means for controlling the discharge means, the guide means, and the filling means, wherein the control means, based on given prescription data, controls the discharge means to discharge the medicine from the reception compartment, or controls the guide means to show the reception compartment into which the medicine should be put. Therefore, a user can easily and securely put the medicine into the reception compartment that should receive the medicine. Thereby, it becomes possible to improve the usability and securely prevent occurrence of wrong preparation of the medicines.

Further, the guide means switchingly shows the reception compartment into which the medicine should be put, depending on a kind of medicine. Therefore, the operability becomes highly excellent even when feeding a plurality of kinds of medicines into different reception compartments in a mixed manner.

Moreover, the guide means comprises display means provided correspondingly to the plurality of reception compartments, and shows the reception compartment into which the medicine should be put, by lighting the display means. Therefore, the user can definitely discriminate the reception compartment to be fed with the medicine from the others. Thereby, it becomes possible to further improve the usability and reliability.

What is claimed is:

1. A tablet packing apparatus with tablet cases that discharge medicine tablets down a chute to a hopper leading to packing machine comprising:

a plurality of reception compartments arranged in line into each of which at least one type of medicine tablet is to be respectively placed selectively, based on prescription data, said reception compartments being open on their upper side, arranged in a line and being movable;

discharge means for discharging medicine tablets from said reception compartments, respectively, to a hopper;

filling means for filling medicine tablets discharged from said hopper into containers;

a guide means comprising a visual display device associated with each of said plurality of reception compartments for prompting a user to add medicine tablets to said reception compartments;

a display panel; and control means for controlling said discharge means, said guide means, and said filling means, wherein said control means, energizes said visual display device associated with a reception compartment into which a type of medicine tablet should be placed and displays the quantity of the medicine tablet per dose on said display panel corresponding to the prescription data, moves said reception compartments along a line to a discharge position, controls said discharge means to discharge the medicine tablets to said hopper from each of said reception compartments as said reception compartment reaches said discharge position, and controls said filling means to fill the medicine tablets discharged from said hopper into containers.

2. A tablet packing apparatus according to claim 1, wherein said guide means selectively identifies said at least one reception compartment into which the medicine tablet should be placed, depending on the type of medicine tablet.

3. A tablet packing apparatus according to claim 1, wherein said visual display devices of said guide means comprises a light emitting device.

4. A tablet packing apparatus according to claim 3 wherein each of said light emitting devices is an LED.

5. A table packing apparatus according to claim 1 further comprising a feeder motor for moving said plurality of reception compartments sequentially to said discharge position.

6. A table packing apparatus according to claim 1, wherein said discharge means comprises a shutter that is opened upon each said reception compartment reaching said discharge position.

7. A table packing apparatus according to claim 5, wherein said discharge means comprises a shutter that is opened upon each said reception compartment reaching said discharge position.

* * * * *